US006197183B1

(12) United States Patent
Iosso

(10) Patent No.: US 6,197,183 B1
(45) Date of Patent: Mar. 6, 2001

(54) ELECTRODEPOSITION BATH FOR WEAR-RESISTANT ZINC ARTICLES

(76) Inventor: Richard C. Iosso, 1485 Lively Blvd., Elk Grove Village, IL (US) 60007

( * ) Notice: Subject to any disclaimer, the term of this patent is extended or adjusted under 35 U.S.C. 154(b) by 0 days.

(21) Appl. No.: 09/506,784

(22) Filed: Feb. 18, 2000

(51) Int. Cl.[7] ..... C25D 3/04
(52) U.S. Cl. ..... 205/286
(58) Field of Search ..... 205/283, 284, 205/285, 286

(56) References Cited

U.S. PATENT DOCUMENTS 2,640,022 * 5/1953 Stareck ..... 205/285
2,686,756 * 8/1954 Stareck et al. ..... 205/286
3,654,101 * 4/1972 Aoun ..... 205/283
4,095,014 * 6/1978 Iosso ..... 428/658
4,156,634 * 5/1979 Iosso ..... 205/286
4,472,249 * 9/1984 Chessin ..... 205/290

* cited by examiner

*Primary Examiner*—Kathryn Gorgos
*Assistant Examiner*—William T. Leader
(74) *Attorney, Agent, or Firm*—Olson & Hierl, Ltd.

(57) ABSTRACT

This invention relates to the electrodeposition of chromium onto zinc or zinc alloys, and particular electrodeposition bath conditions. The chromium plating bath is suitable for enhancing surface hardness of relatively high copper, low aluminum zinc-alloys. The bath is an aqueous solution which includes chromic acid and sulfate ions in amounts so that the weight ratio of chromic acid to the sulfate ions is about 75:1 to about 125:1, respectively. The bath further includes specified amounts of fluoride ion, boric acid and an alkali metal carbonate. The bath may additionally include an alkali metal bicarbonate in a carbonate-to-bicarbonate weight ratio of about 0.6 to about 13:1, respectively.

2 Claims, No Drawings

ELECTRODEPOSITION BATH FOR WEAR-RESISTANT ZINC ARTICLES

BACKGROUND OF THE INVENTION

This invention relates to the electrodeposition of chromium onto zinc or zinc alloys.

A great number of articles, such as machine parts, are fabricated from zinc base metal compositions such as zinc and zinc alloy die castings. Such articles usually are provided with surface finishes which inhibit, reduce, or eliminate corrosion associated with outdoor exposure. A commonly utilized surface finish for these purposes is a composite coating of copper, nickel, and chromium which is applied by first polishing, degreasing and cleaning the surface of the article and thereafter sequentially electrodepositing thereon layers of copper, nickel, and chromium. However, upon prolonged exposure to the elements the electrodeposited surface finishes begin to blister and peel off.

Die casting of zinc base metal is an extremely versatile method of fabricating complex metal shapes with close dimensional tolerances and at a relatively low cost. However, because of susceptibility to corrosion, a protective coating is usually required. Typical such protective coatings are applied by electrodeposition by first applying a copper strike, and then one or more coating of nickel followed by a coating of chromium. While die cast parts produced from zinc base metals provide the basic advantages of cost and weight, corrosion nevertheless is a problem even with the protective coatings. Besides, the wear resistance of such parts is notoriously inadequate for applications involving friction contact between moving surfaces.

The usual commercial chromium plating electrolytes utilized for protective coatings consist of aqueous chromic anhydride ($CrO_3$) solutions, also commonly referred to as chromic acid solutions, which contain certain catalysts which enable the chromium contained in the solution to be electrodeposited. These catalysts usually are sulfate ($SO_4^{=}$) and silicofluoride or fluosilicate ($SiF_6^{=}$) ions. In order to optimize the chromium electrodeposition conditions these catalysts must be present in certain specific relative amounts based on the concentration of chromic acid present in the electrodeposition bath. In the so-called self regulating electrodeposition baths concentrations of the cooperating catalyst ions are controlled automatically by means of the solubility characteristics of the compounds that are used to supply these ions to the bath solution. Illustrative self-regulating chromium electrodeposition baths are disclosed in U.S. Pat. No. 2,640,022 to Stareck and in U.S. Pat. No. 2,686,756 to Stareck et al.

U.S. Pat. Nos. 4,095,014 and No. 4,156,634 to losso describe an effective surface treatment of zinc alloys to provide a wear resistant surface. Recent advances in zinc alloy technology, however, such as the high performance ternary zinc-copper-aluminum alloys, require adjustments in electrodeposition techniques and electrodeposition baths for the development of optimum surface properties. To that end, the present invention provides an improved electrodeposition bath composition well suited for the enhancement of the surface hardness of relatively, high copper, low aluminum zinc alloys.

SUMMARY OF THE INVENTION

An electrodeposition bath suitable for enhancing surface hardness of relatively high copper, low aluminum zinc alloys comprises an aqueous chromic acid solution containing sulfate ions in an amount so that the weight ratio of chromic acid to the sulfate ions is about 75:1 to about 125:1, respectively, and further containing fluoride ion in an amount of about 0.2 to about 0.8 grams per liter of the solution, boric acid in an amount of about 0.1 to about 0.8 grams per liter of the solution, and an alkali metal carbonate in an amount of about 0.4 to about 0.6 grams per liter of said solution.

To provide a fabricated zinc base metal article with the wear-resistant skin and the chromium-enriched sub-surface layer, the fabricated article is precleaned and then immersed in the electrodeposition bath and connected into the electrodeposition circuit as the cathode thereof. Electrodeposition is carried out by passing direct current from a submerged anode to the cathode through the bath and is commenced with an initial strike of relatively short duration (less than about one minute) at an elevated voltage of about 7.5V to about 12.5V. Thereafter chromium from the bath is deposited on the cathode at a relatively lower voltage (at least about 20 percent lower than strike voltage) for a time period of about one minute to about 45 minutes. Chromium electrodeposition takes place at a relatively high current density and at a relatively low bath temperature, the electrodeposition bath temperature can vary from about 90° F. to about 135° F. (about 32° C. to about 57° C.), and preferably is in the range of about 100° F. to about 130° F. (about 38° C. to about 54° C.). The cathode current density is at least about 3.5 amperes per square inch and preferably about 4 to about 5 amperes per square inch. The preferred cathode current density varies to some extent with the configuration of the workpiece, the bath temperature and, at a given current efficiency, generally increases with increasing bath temperature.

As used herein and in the appended claims, by the expression "zinc base metal" is meant zinc or a zinc alloy normally used for the manufacture of die cast parts and containing varying amounts of aluminum, magnesium, copper and similar alloying elements.

DESCRIPTION OF PREFERRED EMBODIMENTS

The electrodeposition bath for practicing the present invention contains about 28 to about 35 ounces of chromic acid per gallon, sulfate ions and other catalysts, and preferably is prepared using deionized water. For continuous electrodeposition the weight ratio of chromic acid ($CrO_3$) to the sulfate ions present in the bath preferably is about 100:1; however, the weight ratio can vary from about 75:1 to about 125:1. The usual source of the sulfate ions is sulfuric acid or sodium sulfate, but it is not important with what particular substance the sulfate ions are combined when entering the bath as long as the sulfate ions become available in the desired concentration upon dissolution of the introduced substance. It should be recognized, however, that some sulfate is likely to be present as an impurity in commercial grades of chromic acid and allowance should be made for sulfate ions that have been introduced into the bath in such a manner. Self-regulating character of the electrodeposition bath is maintained by the addition of fluoride ($F^-$) ions, usually in the form of sodium fluoride, potassium fluoride, and the like. The concentration of dissolved sulfate ions in the bath varies in accordance with the desired ratio of $CrO_3/SO_4^{-2}$. The dissolved sodium fluoride provides a fluoride ion concentration in the range of about 0.2 to about 0.8 grams per liter of solution. The solubility of the sulfate and fluoride ions at the desired chromic acid concentrations, i.e., about 28 to about 35 oz./gallon (210 g/l to 262.5 g/l), so as to provide a bath substantially saturated with respect to the sulfate ions and the fluosilicate ions, is controlled by the addition of an alkali metal carbonate, preferably together with an alkali metal bicarbonate. The relative amounts of carbonate and bicarbonate may vary; however, preferably the weight ratio of carbonate-to-bicarbonate is about 0.6:1 to about 1.3:1, respectively. Most preferably, to provide the common ion effect, if the sulfate source was sodium sulfate, sodium carbonate alone or admixed with sodium bicarbonate is added. Sodium sesquicarbonate can be used as well.

Boric acid is added to the electrodeposition bath to enhance current efficiency and may also serve as a brightening agent for the chromium deposit. Boric acid is usually present in the bath in an amount of about 0.1 to about 0.8 grams per liter. Inasmuch as the throwing power of the bath is reduced by the presence of boric acid, preferably a relatively low concentration of boric acid is maintained in the bath.

To maintain the proper catalyst and additive balance in the bath, it is expedient to prepare a dry chemical composition which can be introduced into the aqueous chromium electrodeposition bath in a predetermined amount. An illustrative composition is shown in Table I, below.

TABLE I

Dry Chemical Composition

| Ingredient | Parts by Weight |
|---|---|
| NaF | 25 |
| $H_3BO_3$ | 37.5 |
| sodium sesquicarbonate[1] | 37.5 |

[1]A mixture of $Na_2CO_3$ and $NaHCO_3$

The present chromium electrodeposition bath can be used for direct electrodeposition of hard chromium onto an article made from a zinc base metal so as to improve the wear resistance, surface hardness, and corrosion resistance thereof. As pointed out hereinabove, by the term "zinc base metal" is meant zinc or a zinc alloy of the type normally used for die casting. Illustrative of such alloys are those described in U.S. Pat. No. 4,990,310 to Rashid et al. as well as ASTM Alloy AG40A (SAE Alloy 903) made with special high grade zinc alloyed with about 4 weight percent aluminum, 0.04 weight percent magnesium, a maximum 0.25 weight percent copper, less than 0.1 weight percent iron, less than 0.005 weight percent lead, less than 0.004 weight percent cadmium, and less than 0.003 weight percent tin. Another typical alloy is ASTM Alloy AC 41A (SAE 925) which is similar in composition to ASTM AG 40A but has a higher copper content, i.e., 0.75 to about 1.25 weight percent copper.

Yet another suitable alloy comprises about 95 weight percent zinc, about 0.125 weight percent copper, about 3.5 weight percent aluminum, about 0.1 weight percent iron, about 0.02 weight percent magnesium, about 0.005 weight percent lead, about 0.004 weight percent cadmium, and about 0.003 weight percent tin.

Prior to the direct electrodeposition of chromium thereon the surface of the fabricated zinc base metal article must be smoothed and precleaned so as to remove grease and oil, zinc oxides and hydroxides, and other undesirable substances. Smoothing can be accomplished by mechanical means such as mechanical polishing with abrasive media, or by vibratory finishing with appropriate abrasive media.

The smoothed, fabricated article can be precleaned using a grease and oil solvent such as trichloroethylene, perchloroethylene, or the like, alkaline washed with a power spray, emulsion cleaned in agitated emulsions of soaps, kerosene, or other hydrocarbons and water to remove non-saponifiable oil and grease if present, or alkaline soak cleaned with a solution containing sodium tripolyphosphate and one or more surfactants.

After precleaning the article can also be subjected to an electrocleaning step, usually by anodic cleaning in a solution containing mixed alkalis such as sodium tripolyphosphate and sodium metasilicate, surfactants, and a small amount of sodium hydroxide. A water rinse is usually performed between the various cleaning operations.

After alkaline cleaning and electrocleaning operations the article is immersed into an acid dip to remove any zinc oxides or hydroxides that may be present and also to neutralize any alkaline compounds that may have been carried over from the electrocleaning operation.

During the actual electrodeposition step the fabricated article is cathodic and, immediately after immersion in the chromium electrodeposition bath, is subjected to an initial strike at an elevated voltage of about 7.5V to about 12.5V, for a time period of less than about one minute and preferably for about 10 to about 45 seconds. Thereafter the electrodeposition voltage is reduced to a value at least about 20 percent less than the strike voltage, preferably to about 4V to about 9V, and the deposition of chromium continued at an average, substantially constant current density of a least about 3.5 amperes per square inch, preferably about 4 to about 5 amperes per square inch, until the desired thickness of skin layer is obtained. For a generally shiny, hard chromium deposit having a thickness of about 20 to about 30 microns the required electrodeposition time period is about 10 minutes to about 20 minutes. At the same time, chromium is driven also into the sublayer and increases the hardness thereof.

Bath temperature and current density are interrelated to some extent. In practicing the present invention the foregoing current densities are maintained at bath temperatures of about 90° F. to about 135° F. (about 32° C. to about 57° C.). The bath temperature should not exceed about 135° F. (about 57° C.), however, because at higher bath temperatures the quality of the deposit suffers and the throwing power of the bath also decreases. For optimum results a bath temperature of about 100° F. (about 38° C.) to about 130° F. (about 54° C.) is preferred. Bath temperatures below about 80° F. (about 27° C.) generally are not desirable because the chromium deposited at such temperatures appears to have a different, less desirable crystalline form.

Anode composition is not overly critical for the purposes of the present invention. Conventional lead-tin alloy electrodes can be utilized. The anode configuration is determined by the cathodic surface of the workpiece on which chromium is to be deposited.

As an illustrative example, a die cast zinc alloy part fabricated from ACuZinc™ 5 zinc base alloy containing copper (about 5–6 wt.-%), aluminum (about 2.8–3.3 wt.-%), magnesium (about 0.025–0.05 wt.-%), iron (0.075 wt.-% max.), lead (0.005 max.), cadmium (0.004 max.), tin (0.003 max.) and the remainder zinc, is appropriately cleaned and rinsed and then immersed into an aqueous chromium electrodeposition bath solution containing about 210 g/l $CrO_3$, about 0.2 g/l total $SO_4^{-2}$, about 0.5 g/l $F^-$, about 0.75 g/l boric acid, about 0.45 g/l sodium carbonate, and about 0.3 g/l sodium bicarbonate.

A relatively low current is passed through the bath as soon as the machine part becomes immersed in the bath solution and then the part is subjected to a 15-second strike at about 9V. Thereafter, electrodeposition of chromium is continued for about 5 minutes at about 5V and at an average current density of about 4.5 amperes per square inch. During electrodeposition, the bath solution temperature is about 130° F. (about 54° C.) and the bath pH about 0.5 to 1.5. After the direct electrodeposition of chromium is terminated, a substantially pure chromium skin layer about 36 microns thick is obtained. The obtained chromium surface exhibits exceptional hardness (a Rockwell C hardness value in excess of about 70) and wear resistance.

As another illustrative example, a die cast zinc alloy machine part, fabricated from a zinc base metal containing zinc (about 95 wt. %), copper (about 1.25 wt. %), aluminum (about 3.5 wt. %), iron (about 0.1 wt. %), magnesium (about 0.2 wt. %), cadmium (about 0.004 wt. %), lead (about 0.005 wt. %), and tin (about 0.003 wt. %) is appropriately cleaned and rinsed and then immersed into an aqueous chromium electrodeposition bath solution containing about 210 g/l $CrO_3$, about 0.2 g/l total $SO_4^{-2}$, about 0.5 g/l $F^-$, about 0.75 g/l boric acid, about 0.45 g/l sodium carbonate, and about 0.3 g/l sodium bicarbonate.

A relatively low current is passed through the bath as soon as the machine part becomes immersed in the bath solution and then the part is subjected to a 15-second strike at about 9V. Thereafter, electrodeposition of chromium is continued for about 5 minutes at about 5V and at an average current density of about 4.5 amperes per square inch. During electrodeposition, the bath solution temperature is about 130° F. (about 54° C.) and the bath pH about 0.5 to 1.5. After the direct electrodeposition of chromium is terminated, a substantially pure chromium skin layer about 36 microns thick is obtained. The obtained chromium surface exhibits exceptional hardness (a Rockwell C hardness value of about 68) and wear resistance.

In general, when practicing the present invention the chromium-enriched subsurface layer that is produced during electrodeposition is at least as thick as the chromium skin layer and usually is even thicker. This chromium-enriched layer is also harder than the zinc base metal casting itself and materially contributes to the wear resistance of the manufactured part. The chromium content of the enriched subsurface layer is at least about 0.1 percent by weight and preferably at least about 0.4 percent by weight.

The foregoing specification is intended to be illustrative and is not to be taken as limiting. Still other variations within the spirit and scope of this invention are possible and will readily present themselves to one skilled in the art.

I claim:

1. A chromium direct electrodeposition bath which comprises an aqueous chromic acid and sulfate solution wherein the chromic acid and the sulfate are present in a weight ratio of about 75:1 to about 125:1, respectively, and containing fluoride ion in an amount of about 0.2 to about 0.8 grams/liter of the solution, boric acid in an amount of about 0.1 to about 0.8 grams/liter of the solution, and an alkali metal carbonate in an amount of about 0.4 to about 0.6 grams/liter of the solution.

2. The electrodeposition bath in accordance with claim 1 wherein additionally an alkali metal bicarbonate is present in the solution in a carbonate-to-bicarbonate weight ratio of about 0.6:1 to about 1.3:1, respectively.

* * * * *